US006761193B1

(12) United States Patent
Cotton et al.

(10) Patent No.: US 6,761,193 B1
(45) Date of Patent: Jul. 13, 2004

(54) FUEL LEVEL SENSOR AND PUMP ASSEMBLY

(75) Inventors: Kenneth J. Cotton, Caro, MI (US); Jeffrey D. Hanby, Cass City, MI (US); Gerald A. Hill, Cass City, MI (US); Jeffrey C. Hoppe, Cass City, MI (US); Roger N. Smith, Ubly, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 10/640,599

(22) Filed: Aug. 13, 2003

(51) Int. Cl.[7] ..... B65B 1/04; B65B 3/04; B67C 3/02

(52) U.S. Cl. ..... 141/98; 141/95; 141/198; 417/360; 210/232

(58) Field of Search ..... 141/94, 95, 98, 141/192, 198; 417/40, 360, 53; 210/232, 416.4

(56) References Cited

U.S. PATENT DOCUMENTS 4,706,707 A * 11/1987 Betterton et al. ..... 137/565.24
6,000,913 A * 12/1999 Chung et al. ..... 417/53
6,436,287 B1 * 8/2002 Fischerkeller et al. ..... 210/232

* cited by examiner

*Primary Examiner*—Timothy L. Maust
(74) *Attorney, Agent, or Firm*—Reising, Ethington, Barnes, Kisselle, P.C.

(57) ABSTRACT

A level sensor and fuel pump assembly insertable through an access hole of a fuel tank so that an elongated fuel pump is disposed substantially completely within the fuel tank, and so that a flange of the assembly covers the hole and is engaged sealably to the wall of the fuel tank. The fuel level sensor has an arm which projects generally laterally when in a biased operating position from the elongated fuel pump to a float at a distal end. During insertion of the fully pre-assembled fuel sensor and pump assembly through the access hole of the fuel tank, the fuel level sensor is pivoted from the biased operating position to a collapsed position by an external force thus pivoting the fuel level sensor generally parallel, and closely orientated, to the fuel pump. This temporary orientation permits insertion of the fuel pump assembly through the relatively small access hole of the tank. After insertion, the external force is released and the fuel level sensor pivots from the collapsed position back to the operating position.

17 Claims, 3 Drawing Sheets

FUEL LEVEL SENSOR AND PUMP ASSEMBLY

FIELD OF THE INVENTION

This invention relates to a fuel pump assembly, and more particularly to a multi-pivoting float-type fuel level sensor of the fuel pump assembly.

BACKGROUND OF THE INVENTION

A fuel pump assembly for a liquid fuel tank of a vehicle is known to have a flange mounted sealably to a wall of the tank with an electric fuel pump of the assembly carried by the flange and disposed in the interior of tank. The fuel pump has a fuel inlet typically extending from a fuel filter, and a fuel outlet which is typically a tube or fuel resistant hose connected to a fitting extending through the flange to supply fuel to the vehicle engine. A connector for electrical wires also projects through the flange to provide electrical power to the pump and send a fuel level signal from the sensor to a remote fuel level indicator.

The wall of the fuel tank has a peripheral edge which defines an access hole through which the fuel pump assembly projects into the tank. An O-ring, or any variety of fuel resistant gaskets or seals are typically compressed between a circumferential shoulder of the flange and the peripheral edge of the tank wall to prevent fuel leakage and fuel vapor permeation egress from the tank. To control manufacturing costs, preserve the structural integrity of the tank, and minimize any opportunity of seal failure, the access hole is substantially round and minimal in diameter, yet, large enough to permit insertion of the fuel pump assembly into the tank.

The fuel pump and any variety of structures which attach, support, and/or communicate the pump with the flange are typically elongated and compact in design having a centerline which is generally parallel to a centerline of the access hole during insertion of the fuel pump assembly into the fuel tank. Unfortunately, other components of the fuel pump assembly which substantially project laterally from the pump centerline obstruct insertion of the full assembly through the small access hole, thus laterally projecting components of the pump assembly must be assembled to the remainder of the assembly inside the tank.

One such component of the fuel pump assembly is a fuel level sensor with a wiper-arm type float mechanism which typically has an elongated wiper arm engaged pivotally connected to a carrier of a resistor card at one end and engaged to a float at an opposite distal end. The float is buoyant upon the surface of the liquid fuel contained within the tank so that as the fuel level varies, the resultant change in float elevation causes an electrical contact engaged to the wiper arm to pivot or sweep across a series of electrical contacts of a variable resistor rigidly attached to the pump. The wiper arm projects generally laterally from the fuel pump. This is particularly true for fuel tank applications where the pump centerline descends into the tank at an angle projecting away from the downward sweep of the wiper arm. The length of the wiper arm is dictated by the changing fuel surface elevation range (i.e. between a full and an empty tank of fuel).

Unfortunately, the substantial length or lateral projection of the wiper arm from the pump centerline obstructs insertion of a fully pre-assembled fuel level sensor and pump assembly into the tank through the small access hole. Thus, either the wiper arm must be assembled to the fuel pump bracket after the pump is inserted into the tank, which leads to greater manpower and expense during manufacturing, or the access hole must be enlarged beyond a desirable size which leads to a weakening of the tank structure, a greater potential of fuel leakage and/or permeation egress through the seal, and greater material and manufacturing costs.

SUMMARY OF THE INVENTION

A fuel level sensor and pump assembly inserts through an access hole of a fuel tank so that an elongated fuel pump is disposed preferably generally vertically and completely within the fuel tank, and so that a flange of the assembly is engaged sealably to the wall of the fuel tank about a peripheral edge which defines the access hole. A multi-pivoting fuel level sensor mechanism generally projects laterally when in a biased operating position from the elongated fuel pump to a float at a distal end. During insertion of the fully pre-assembled fuel level sensor and pump assembly through the access hole of the fuel tank, the fuel level sensor mechanism is pivoted by an external force from the biased operating position to a collapsed position substantially parallel, and closely orientated, to the fuel pump. This temporary collapsed orientation permits insertion of the fuel level sensor and pump assembly through the relatively small access hole of the tank. After insertion, the external force is released and the fuel level mechanism pivots from the collapsed position back to the operating position.

A base of the fuel level sensor mechanism is pivotally carried by the fuel pump enabling movement between the operating and collapsed positions. An elongated wiper arm of the fuel level sensor mechanism by pivotally carried by the base and projects to a distal end which is preferably engaged pivotally to a float. The base carries a variable resistor which senses fuel level as the wiper arm is swept across a series of contacts of the resistor caused by the buoyant float in response to the varying fuel level. Preferably, the pivotal connection between the base and the fuel pump has a stationary pin which passes through an eyelet of the base and is attached to the fuel pump. A spring preferably coils about the pin and engages the fuel pump at one end and the base at the other end to resiliently bias the fuel level sensor mechanism into its operating position.

Objects, features and advantages of this invention include a fully pre-assembled fuel level sensor and pump assembly that can be inserted into a fuel tank through a relatively small access hole. Other advantages are a structurally strong fuel tank, superior sealing of the access hole of the tank, simplified overall assembly of the fuel level sensor, pump and tank, reduced manufacturing costs, and an overall cost effective, robust, and low maintenance design.

BRIEF DESCRIPTION OF THE DRAWINGS

These and other objects, features and advantages of this invention will be apparent from the following detailed description of the preferred embodiment and best mode, appended claims, and accompanying drawings in which:

DETAILED DESCRIPTION OF THE PREFERRED EMBODIMENTS

Figure 1:
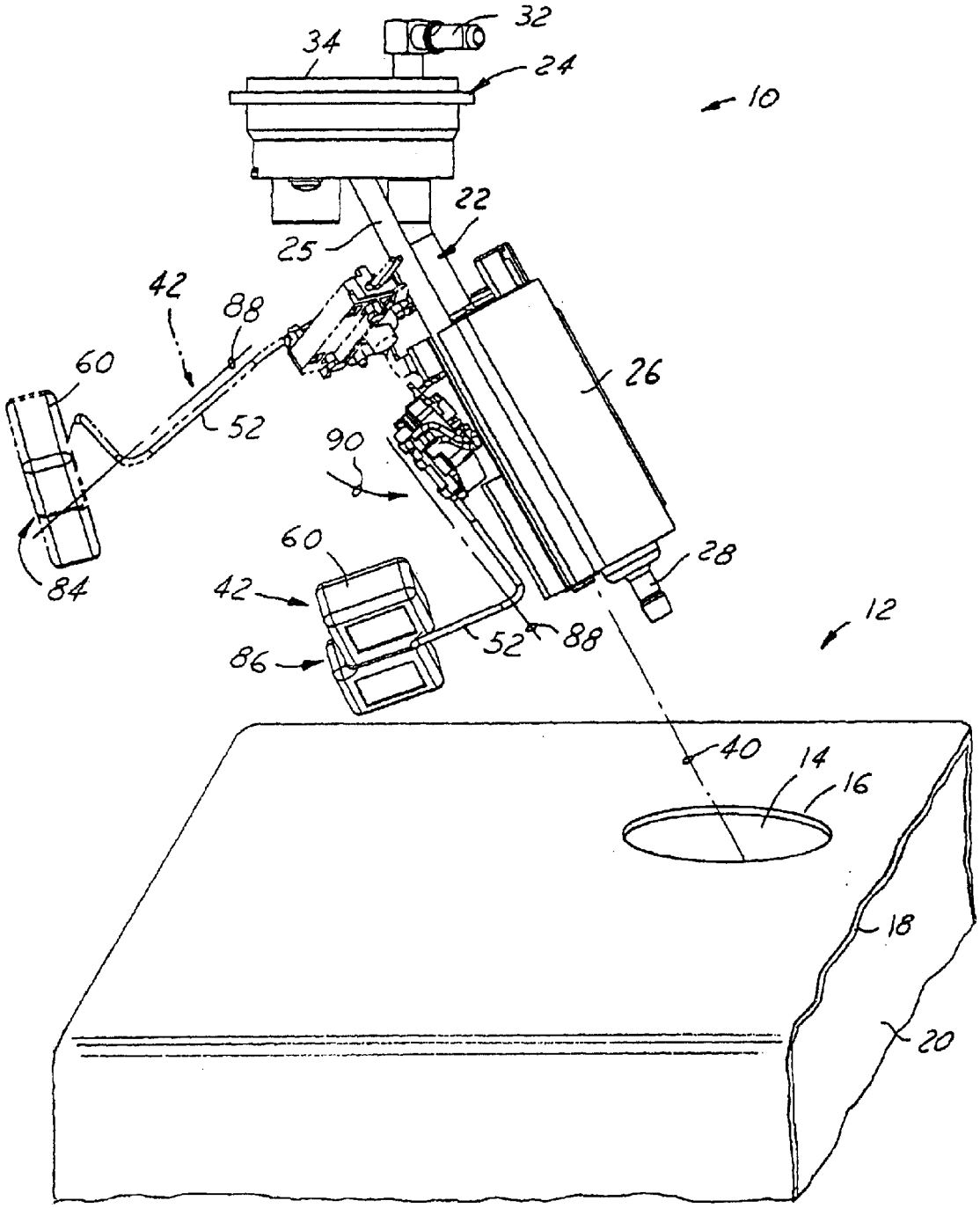
FIG. 1 is a perspective view of a fuel pump assembly of the present invention positioned outside of a fuel tank and illustrating a fuel level sensor mechanism in a collapsed position and an operating position (shown in phantom).

Referring in more detail to the drawings, FIG. 1 illustrates a fully pre-assembled fuel level sensor and pump assembly 10 of the present invention being inserted into a liquid fuel tank 12 through an access hole 14 defined by a peripheral edge 16 of a tank wall 18 which defines an interior or fuel chamber 20. The fuel sensor and pump assembly 10 has an elongated electric fuel pump 22 disposed in the fuel chamber 20 when assembled and a substantially cylindrical flange 24 attached to the fuel pump 22 via a pair of parallel posts 25 of a bracket 26. When fully assembled to the tank 12, the flange 24 is engaged sealably to the peripheral edge 16 of the fuel tank wall 18 and the pump 22 is suspended within the fuel chamber 20 from the flange 24, posts 25 and a bracket 26.

Figure 2:
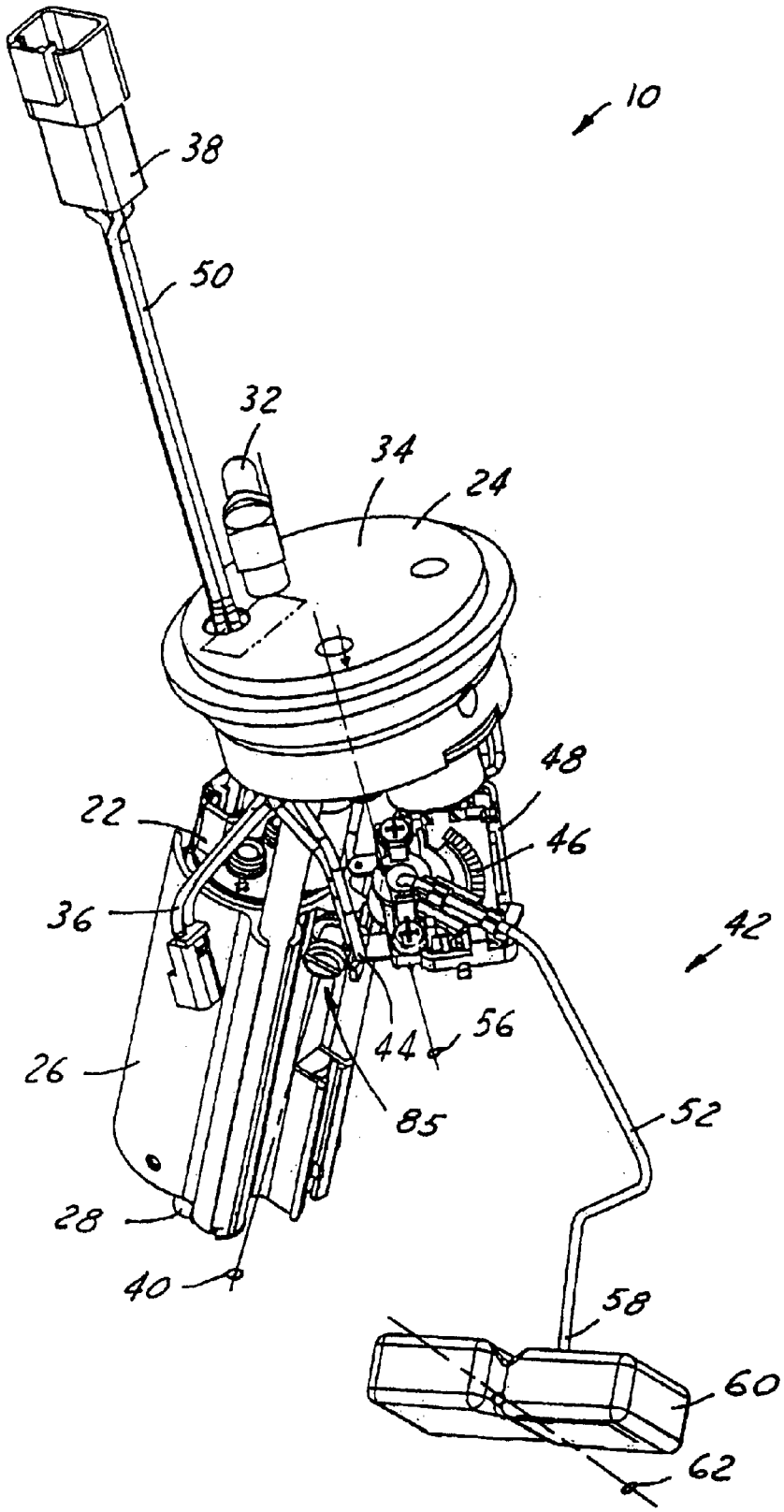
FIG. 2 is a perspective view of the fuel sensor and pump assembly illustrated in the operating position.

The fuel pump 22 has a fuel inlet 28 which preferably extends from a fuel filter (not shown), and a fuel outlet 30 which is preferably a tube or fuel resistant hose that communicates with a passage through the cylindrical flange 24 to a fuel supply fitting 32 mounted rigidly or threadably on an exterior surface 34 of the flange 24. A pair of electrical leads 36, with associated connectors 38, extend through the flange 24 providing electrical power to an electric motor of the fuel pump 22 (as best shown in FIG. 2). Because both the electrical leads 36 and the fuel outlet 30 extend through the flange 24, the number of tank penetrations are kept to a minimum, which is preferably one, maintaining a structurally strong and leak-proof tank and minimizing manufacturing costs. Similarly, the posts 25 are secured to the underside of the flange 24, reducing the complexity and thus cost of manufacturing the tank 12 because the posts 25 and bracket 26 need not be secured remotely from the flange 24 to the tank wall 18.

The fuel pump assembly 10 is generally elongated and substantially co-extends with the elongated fuel pump 22 along a longitudinal centerline 40. The access hole 14 of the fuel tank 12 is substantially round and sized to have a minimal diameter which is large enough to permit insertion of the generally cylindrical and compact design of the fuel pump 22.

Figure 3:
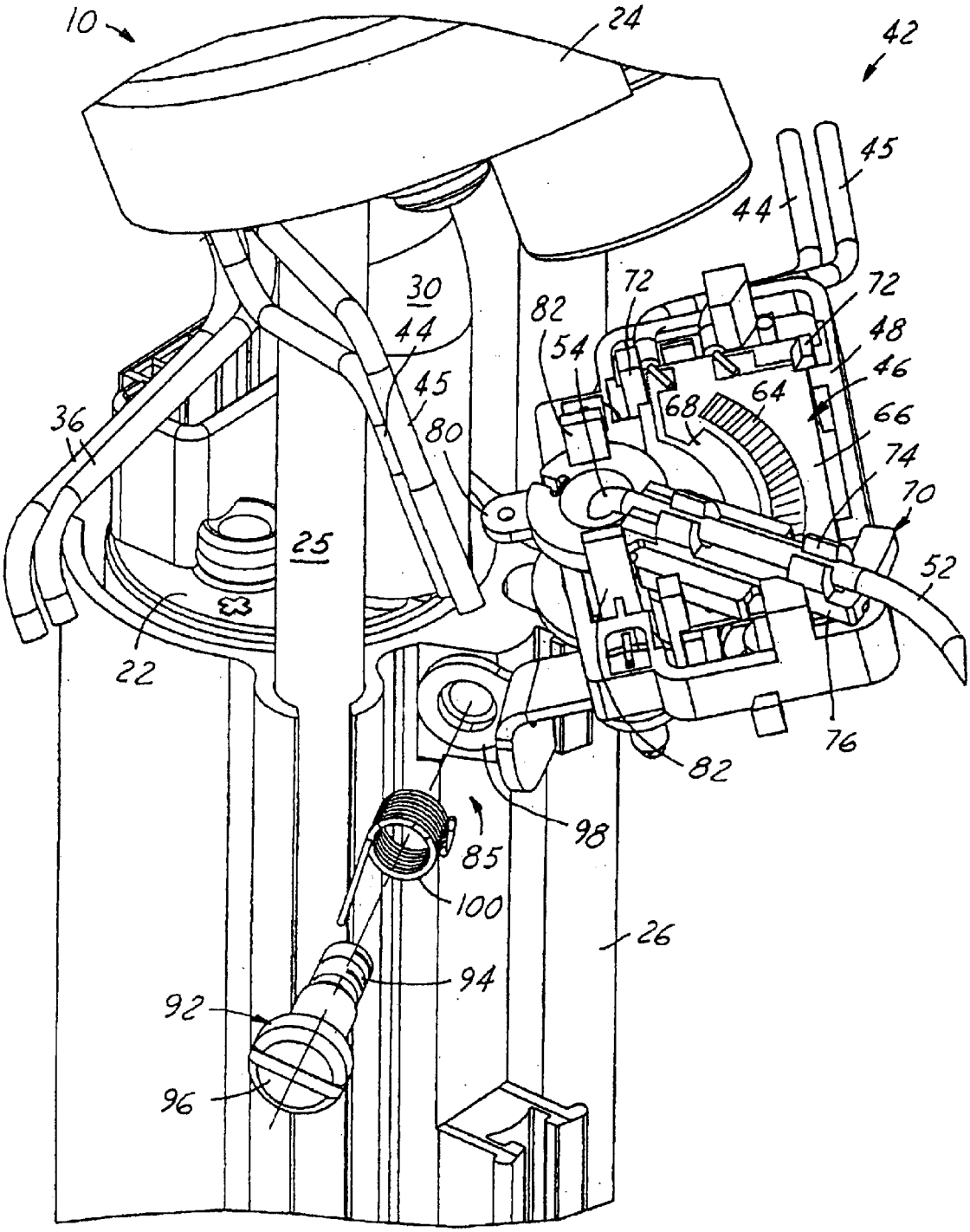
FIG. 3 is a partial enlarged perspective and exploded view of the fuel sensor pump assembly illustrating a base of the fuel level sensor mechanism in the operating position.

Referring to FIGS. 1–3, the fuel pump assembly 10 has an elongated fuel level sensor 42 with a wiper-type float mechanism which sends a fuel level signal, via a pair of electric wires 44 and 45, to a fuel level indicator or meter typically mounted to an instrument panel of the vehicle (not shown). The wires 44, 45 are connected to a variable resistor 46 on a card 66 snap fitted or seated within a plastic base 48 pivotally connected to the bracket 26. The pair of wires 44, 45 extend through the flange 24 along with the leads 36 to form a wire harness 50 projecting outward from the tank 12, as best shown in FIG. 2.

An elongated wiper arm 52 has a base end 54 bent at an approximate right angle and carried pivotally by the base 48 to pivot about an axis 56, as best illustrated in FIG. 2. An opposite distal end 58 of the wiper arm 52, also bent at an approximate right angle, pivotally carries a buoyant or hollow plastic float 60 which pivots about an axis 62. The axis 56 is generally parallel to the axis 62.

The buoyant float 60 is generally planar or low-lying and rectangular or cylindrical in shape and floats on the surface of fuel contained within the tank 12. As the fuel level changes, the float 60 rises or lowers with the fuel surface causing the wiper arm 52 to pivot at the base end 54, thus wiping or sweeping an electrically conductive contact (not shown) across the variable resistor 46 producing the fuel level signal carried by the wires 44, 45 to the fuel level indicator (not shown). The length of the wiper arm 52 is dictated by the shape or depth of the tank 12. That is, the wiper arm 52 must be long enough to allow the float 60 to float upon the surface of fuel between a minimum and maximum elevation (i.e. empty to full fuel tank conditions).

Referring to FIG. 3, the variable resistor 46 has a series of contacts 64 imprinted upon a circuit board or card 66 and generally arranged side-by-side forming a semi-circular or arcuate orientation to preferably coincide with the pivoting axis 56 of the wiper arm 52. The contacts 64 are engaged electrically to the first wire 45. The second wire 44 engages electrically to a semi-circular or arcuate contact 68 also imprinted upon the card 66 and preferably coinciding with the pivot axis. The contact 66 is spaced radially from the series of contacts 64 and extends circumferentially with the series of contacts 64 so that an electrical contact mounted on the bottom side of a non-conductive or plastic saddle 70, attached to the base end 54 of the wiper arm 52, engages and electrically bridges the neutral contact 68 with a predetermined one, or a few, of the series of contacts 64 as the wiper arm 52 is swept across the card 66 by the buoyant float 60 responding to the varying fuel level.

During pre-assembly, the card 66 snap fits into and is retained on the plastic base 48 by a plurality of catch tabs 72 projecting unitarily from the base 48 to engage opposing edges of the card 66. Similarly, the saddle 70 has a pair of opposed tabs 74 which project upward from a longitudinal portion 76 of the saddle 70 and snap fit about and retain the wiper arm 52 near the base end 54. The longitudinal portion 76 projects radially outward from a bushing portion 80 of the saddle 70 which concentrically seats and retains the bent base end 54 of the wiper arm 52. The bushing portion 80 snap fits and seats rotationally into a bore of the base 48. A pair of diametrically opposed prongs 82 of the base 48 retain and prevent the bushing portion 80 from axially slipping out of the bore.

After assembly and during operation of the fuel pump assembly 10, the elongated fuel level sensor mechanism 42 is in an operating position 84 and projects substantially laterally outward from the elongated fuel pump 22 and bracket 26 regardless of fuel level. Because this lateral extension of the fuel level mechanism 42 would obstruct insertion of the fuel level sensor and pump assembly 10 through the access hole 14 of the tank 12 during assembly, the mechanism 42 is moveable to a collapsed position 86, via a pivotal connection 85 between the base 48 and the bracket 26. When in the collapsed position 86, a general centerline 88 of the elongated fuel level sensor mechanism 42 is substantially close to and generally parallel with the centerline 40 of the pump 22.

During insertion of the fuel pump assembly 10 into the fuel tank 12, the fuel level sensor mechanism 42 is moved to the collapsed position 86 by a continuously and usually manually applied force, indicated by arrow 90 in FIG. 1, in order to clear or pass through the hole 14 of the tank 12, as previously described. After insertion of the fuel pump assembly 10, the external force 90 is relieved and the fuel level sensor mechanism 42 pivots or automatically springs back to a biased operating position 84. Because the pump centerline 40 descends into the tank at a substantial angle projecting away from the downward sweep of the wiper arm 52, the centerline 88 of the fuel level sensor mechanism 42 is at a significant angle and in some tanks substantially perpendicular to the centerline 40 of the elongated fuel pump 22 particularly when the fuel level is mid-way between empty and full tank conditions.

The pivotal connection 85 has a pintle pin 92 engaged threadably to the bracket 26 at one end 94. The pin 92 projects through an eyelet 98 of the base 48. Axial displacement of the eyelet 98 along the pin 92 is limited by an opposite enlarged distal head 96 of the pin 92. A torsion spring 100 is coiled concentrically about the pin 92 and disposed axially adjacent to the eyelet 98. A first end of the spring 100 engages the pivoting eyelet 98 or base 48, and an opposite second end of the spring engages the stationary pin 92 or bracket 26. When the fuel level mechanism 42 is moved from the operating position 84 to the collapsed position 86, via force 90, the spring 100 coils or winds about the pin 92. When the applied force is released, the spring 100 uncoils biasing the float level mechanism 42 generally upward and back to the operating position 84.

While the forms of the invention herein disclosed constitute a presently preferred embodiment, many others are possible. It is not intended herein to mention all the possible equivalent forms or ramification of the invention. It is understood that terms used herein are merely descriptive, rather than limiting, and that various changes may be made without departing from the spirit or scope of the invention as defined by the following claims.

We claim:

1. A fuel level sensor and pump assembly inserted into a fuel tank through an access hole of a fuel tank and attached to the fuel tank, the assembly comprising:

a fuel pump having a centerline;

a fuel level sensor mechanism pivotally carried by the fuel pump, the fuel level sensor mechanism having a collapsed position for inserting the fuel pump assembly through the access hole of the fuel tank, an operating position orientating the fuel level mechanism within the fuel tank, and a centerline; and wherein the centerline of the fuel level sensor mechanism is substantially parallel to the centerline of the fuel pump subassembly when in the insertion position; and wherein the fuel level sensor mechanism pivots from the insertion position to the operating position so that the centerline of the fuel level sensor mechanism is transverse to the centerline of the fuel pump.

2. The assembly set forth in claim 1 comprising a spring engaged between the fuel level sensor mechanism and the fuel pump for biasing the fuel level sensor mechanism into the operating position.

3. The assembly set forth in claim 2 comprising:

a pin engaged to the fuel pump; and wherein the fuel level sensor mechanism is engaged pivotally about the pin.

4. The assembly set forth in claim 3 wherein the spring is coiled about the pin and engaged to the fuel pump at one end and engaged to the fuel level sensor mechanism at an opposite end.

5. The assembly set forth in claim 1 comprising:

a base of the fuel level sensor mechanism engaged pivotally to the fuel pump;

a float of the fuel level sensor mechanism which floats upon a surface of liquid fuel within the fuel tank; and an elongated wiper arm engaged between the base and the float.

6. The assembly set forth in claim 5 comprising:

a variable resistor card engaged to the base; and wherein the wiper arm is engaged pivotally to the base about a pivoting axis.

7. The assembly set forth in claim 6 wherein the float is engaged pivotally to the arm about a pivot axis and wherein the pivot axis of the wiper arm is substantially perpendicular to the pivot axis of the float.

8. The assembly set forth in claim 6 wherein the base pivots with respect to the fuel pump along a first imaginary plane and the wiper arm pivots with respect to the base along a second imaginary plane, and wherein the first imaginary plane traverses the second imaginary plane.

9. A fuel level sensor and pump assembly inserted into a fuel tank through an access hole of a fuel tank and attached to the fuel tank, the assembly comprising:

a flange covering the hole and engaged sealably to the fuel tank;

an elongated fuel pump carried by the flange, and disposed in the fuel tank;

an elongated fuel level sensor mechanism pivotally carried by the flange, the fuel level sensor mechanism having a collapsed position wherein the fuel level sensor mechanism is disposed substantially parallel to the elongated fuel pump and an operating position wherein the fuel level sensor mechanism is disposed transversely to the fuel pump; and a spring engaged between the fuel level sensor mechanism and the fuel pump for yieldably biasing the fuel level sensor mechanism into the operating position.

10. The assembly set forth in claim 9 comprising:

a pin projecting laterally from the fuel pump;

wherein the spring is coiled about the pin; and wherein the fuel level sensor mechanism is engaged pivotally about the pin.

11. The assembly set forth in claim 10 comprising:

a base of the fuel level sensor mechanism engaged pivotally to the pin;

a float of the fuel level sensor mechanism for floating upon the surface of the liquid fuel; and an elongated wiper arm of the fuel level sensor mechanism engaged between the base and the float.

12. The assembly set forth in claim 11 comprising:

a variable resistor card engaged to the base; and wherein the wiper arm is engaged pivotally to the base.

13. The assembly set forth in claim 12 wherein the float is engaged pivotally to the wiper arm.

14. The assembly set forth in claim 13 comprising:

an elongated bracket engaged between the flange and the fuel pump; and wherein the bracket descends from the flange at an angle sloping away from a downward pivoting sweep of the wiper arm with respect to the base.

15. The fuel pump assembly set forth in claim 14 wherein the fuel pump is disposed parallel to the bracket.

16. The fuel pump assembly set forth in claim 15 wherein the pin projects laterally from the bracket.

17. A fuel level sensor and pump assembly for insertion through an access hole into a fuel tank comprising, a mounting flange, a fuel pump carried by the flange, a fuel level sensor mechanism carried by the flange having an elongated wiper arm pivotally carried by a base and having a float carried by the wiper arm distal from the base, and a bracket pivotally carrying the base so that the float arm is movable between an operating position extending from the pump laterally so that the assembly cannot be inserted through the access hole when the fuel level sensor mechanism is in the operating position and movable to an insertion position adjacent the pump so that the fuel level sensor mechanism and pump can be inserted through the hole and into the tank.

* * * * *